US008469480B2

(12) United States Patent
Veenstra

(10) Patent No.: US 8,469,480 B2
(45) Date of Patent: Jun. 25, 2013

(54) ADJUSTMENT OF A PRINT ARRAY AND A SUBSTRATE IN A PRINTING DEVICE

(75) Inventor: Hylke Veenstra, Reuver (NL)

(73) Assignees: Océ Technologies B.V, Venlo (NL); Mutracx, Helmond (NL)

( * ) Notice: Subject to any disclaimer, the term of this patent is extended or adjusted under 35 U.S.C. 154(b) by 0 days.

(21) Appl. No.: 12/953,006

(22) Filed: Nov. 23, 2010

(65) Prior Publication Data

US 2011/0069105 A1 Mar. 24, 2011

Related U.S. Application Data

(60) Provisional application No. PCT/EP2009/056282, filed on May 25, 2009.

(30) Foreign Application Priority Data

May 23, 2008 (EP) ..... 08156803

(51) Int. Cl.
*B41J 29/393* (2006.01)
*B41J 2/015* (2006.01)
*B41J 29/38* (2006.01)

(52) U.S. Cl.
USPC ..... 347/19; 347/9; 347/20

(58) Field of Classification Search
USPC ..... 347/19, 37, 9, 20, 14, 16
See application file for complete search history.

(56) References Cited

U.S. PATENT DOCUMENTS 4,675,696 A * 6/1987 Suzuki ..... 346/46
6,454,390 B1 * 9/2002 Takahashi et al. ..... 347/41
6,561,615 B2 * 5/2003 Okawa et al. ..... 347/19
6,758,550 B2 * 7/2004 Ito et al. ..... 347/40
7,036,904 B2 * 5/2006 King et al. ..... 347/19
7,478,894 B2 * 1/2009 Kim et al. ..... 347/19
2003/0144815 A1 7/2003 Kohler et al.
2005/0052494 A1 3/2005 Takahashi et al.
2006/0158476 A1 * 7/2006 Ng et al. ..... 347/19

FOREIGN PATENT DOCUMENTS

DE 198 29 280 A1 6/1999

* cited by examiner

*Primary Examiner* — Jason Uhlenhake

(74) *Attorney, Agent, or Firm* — Birch, Stewart, Kolasch & Birch, LLP

(57) ABSTRACT

A method for adjusting a recording substrate and at least one array relative to each other, the array being part of a printing device having a carrying structure for mounting the array. The array has nozzles arranged in a row substantially parallel to a direction for forming second test marks on a recording substrate, the substrate being pre-printed with first test marks. The array and the recording substrate are in an attainable relative position. The method comprises forming a test pattern having the first and second test marks and detecting the locations of the first and second test marks; determining a plurality of deviation factors for a plurality of attainable relative positions based on said detected locations, wherein each one of said deviation factors is an attribute of a distinct attainable relative position and is indicative of an amount by which distances between neighboring first and second marks deviate from a nominal distance; and selecting an attainable relative position among the plurality of attainable relative positions which satisfies a selection criterion applied to the plurality of deviation factors.

23 Claims, 9 Drawing Sheets

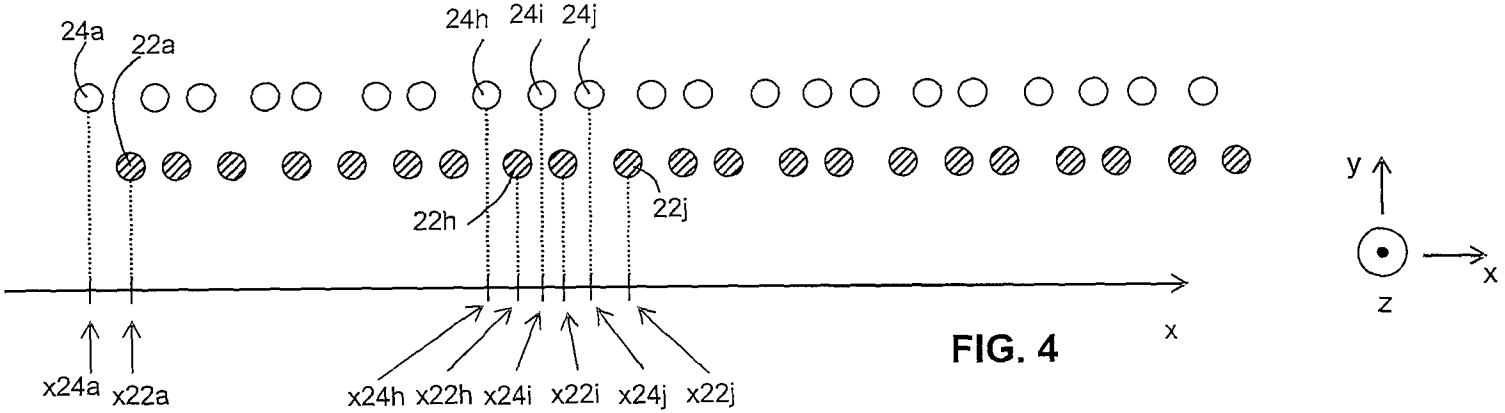
FIG. 4
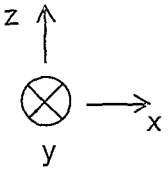
FIG. 11
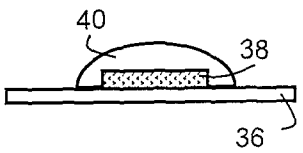
FIG. 12B
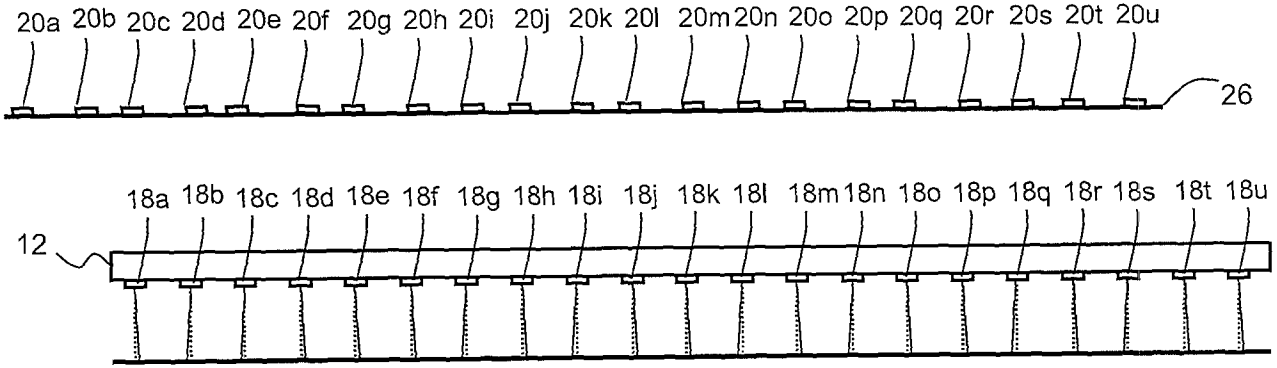
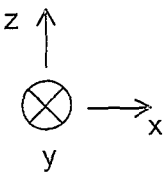
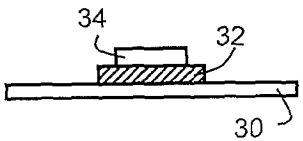
FIG. 12A

| Mark # | x (a.u.) |
|---|---|
| 24a | -10 |
| 22a | 50 |
| 24b | 90 |
| 22b | 110 |
| 24c | 150 |
| 22c | 190 |
| 24d | 250 |
| 22d | 290 |
| 24e | 300 |
| 22e | 370 |
| 24f | 410 |
| 22f | 450 |
| 24g | 470 |
| 22g | 510 |
| 24h | 570 |
| 22h | 610 |
| 24i | 650 |
| 22i | 670 |
| 24j | 710 |
| 22j | 770 |
| 24k | 810 |
| 22k | 850 |
| 24l | 870 |
| 22l | 910 |
| 24m | 970 |
| 22m | 1010 |
| 24n | 1050 |
| 22n | 1070 |
| 24o | 1110 |
| 22o | 1170 |
| 24p | 1210 |
| 22p | 1250 |
| 24q | 1270 |
| 22q | 1310 |
| 24r | 1370 |
| 22r | 1410 |
| 24s | 1450 |
| 22s | 1470 |
| 24t | 1510 |
| 22t | 1570 |
| 24u | 1610 |
| 22u | 1650 |

FIG. 6

POSITION P1

L1

| | | | |
|---|---|---|---|
| $d_{11}$= | 60 | $\Delta_{11}$= | 20 |
| $d_{12}$ | 40 | $\Delta_{12}$ | 0 |
| $d_{13}$ | 20 | $\Delta_{13}$ | 20 |
| $d_{14}$ | 40 | $\Delta_{14}$ | 0 |
| $d_{15}$ | 40 | $\Delta_{15}$ | 0 |
| $d_{16}$ | 60 | $\Delta_{16}$ | 20 |
| $d_{17}$ | 40 | $\Delta_{17}$ | 0 |
| $d_{18}$ | 10 | $\Delta_{18}$ | 30 |
| $d_{19}$ | 70 | $\Delta_{19}$ | 30 |
| $d_{110}$ | 40 | $\Delta_{110}$ | 0 |
| $d_{111}$ | 40 | $\Delta_{111}$ | 0 |
| $d_{112}$ | 20 | $\Delta_{112}$ | 20 |
| $d_{113}$ | 40 | $\Delta_{113}$ | 00 |
| $d_{114}$ | 60 | $\Delta_{114}$ | 20 |
| $d_{115}$ | 40 | $\Delta_{115}$ | 0 |
| $d_{116}$ | 40 | $\Delta_{116}$ | 0 |
| $d_{117}$ | 20 | $\Delta_{117}$ | 20 |
| $d_{118}$ | 40 | $\Delta_{118}$ | 0 |
| $d_{119}$ | 60 | $\Delta_{119}$ | 20 |
| $d_{120}$ | 40 | $\Delta_{120}$ | 0 |
| $d_{121}$ | 40 | $\Delta_{121}$ | 0 |
| $d_{122}$ | 20 | $\Delta_{122}$ | 20 |
| $d_{123}$ | 40 | $\Delta_{123}$ | 0 |
| $d_{124}$ | 60 | $\Delta_{124}$ | 20 |
| $d_{125}$ | 40 | $\Delta_{125}$ | 0 |
| $d_{126}$ | 40 | $\Delta_{126}$ | 0 |
| $d_{127}$ | 20 | $\Delta_{127}$ | 20 |
| $d_{128}$ | 40 | $\Delta_{128}$ | 0 |
| $d_{129}$ | 60 | $\Delta_{129}$ | 20 |
| $d_{130}$ | 40 | $\Delta_{130}$ | 0 |
| $d_{131}$ | 40 | $\Delta_{131}$ | 0 |
| $d_{132}$ | 20 | $\Delta_{132}$ | 20 |
| $d_{133}$ | 40 | $\Delta_{133}$ | 0 |
| $d_{134}$ | 60 | $\Delta_{134}$ | 20 |
| $d_{135}$ | 40 | $\Delta_{135}$ | 0 |
| $d_{136}$ | 40 | $\Delta_{136}$ | 0 |
| $d_{137}$ | 20 | $\Delta_{137}$ | 20 |
| $d_{138}$ | 40 | $\Delta_{138}$ | 0 |
| $d_{139}$ | 60 | $\Delta_{139}$ | 20 |
| $d_{140}$ | 40 | $\Delta_{140}$ | 0 |
| $d_{141}$ | 40 | $\Delta_{141}$ | 0 |

FIG. 7A

POSITION P3

L3

| | | | |
|---|---|---|---|
| $d_{35}$= | 60 | $\Delta_{35}$= | 20 |
| $d_{36}$ | 40 | $\Delta_{36}$ | 0 |
| $d_{37}$ | 20 | $\Delta_{37}$ | 20 |
| $d_{38}$ | 30 | $\Delta_{38}$ | 10 |
| $d_{39}$ | 50 | $\Delta_{39}$ | 10 |
| $d_{310}$ | 60 | $\Delta_{310}$ | 20 |
| $d_{311}$ | 40 | $\Delta_{311}$ | 0 |
| $d_{312}$ | 20 | $\Delta_{312}$ | 20 |
| $d_{313}$ | 60 | $\Delta_{313}$ | 20 |
| $d_{314}$ | 40 | $\Delta_{314}$ | 0 |
| $d_{315}$ | 40 | $\Delta_{315}$ | 0 |
| $d_{316}$ | 40 | $\Delta_{316}$ | 0 |
| $d_{317}$ | 20 | $\Delta_{317}$ | 0 |
| $d_{318}$ | 40 | $\Delta_{318}$ | 0 |
| $d_{319}$ | 60 | $\Delta_{319}$ | 20 |
| $d_{320}$ | 40 | $\Delta_{320}$ | 0 |
| $d_{321}$ | 20 | $\Delta_{321}$ | 20 |
| $d_{322}$ | 40 | $\Delta_{322}$ | 0 |
| $d_{323}$ | 60 | $\Delta_{323}$ | 20 |
| $d_{324}$ | 40 | $\Delta_{324}$ | 0 |
| $d_{325}$ | 40 | $\Delta_{325}$ | 0 |
| $d_{326}$ | 40 | $\Delta_{326}$ | 0 |
| $d_{327}$ | 20 | $\Delta_{327}$ | 20 |
| $d_{328}$ | 40 | $\Delta_{328}$ | 0 |
| $d_{329}$ | 60 | $\Delta_{329}$ | 20 |
| $d_{330}$ | 40 | $\Delta_{330}$ | 0 |
| $d_{331}$ | 20 | $\Delta_{331}$ | 0 |
| $d_{332}$ | 60 | $\Delta_{332}$ | 20 |
| $d_{333}$ | 60 | $\Delta_{333}$ | 20 |
| $d_{334}$ | 40 | $\Delta_{334}$ | 0 |
| $d_{335}$ | 40 | $\Delta_{335}$ | 0 |
| $d_{336}$ | 40 | $\Delta_{336}$ | 0 |
| $d_{337}$ | 20 | $\Delta_{337}$ | 20 |
| $d_{338}$ | 40 | $\Delta_{338}$ | 0 |
| $d_{339}$ | 60 | $\Delta_{339}$ | 20 |
| $d_{340}$ | 40 | $\Delta_{340}$ | 0 |
| $d_{341}$ | 20 | $\Delta_{341}$ | 20 |

FIG. 7B

ADJUSTMENT OF A PRINT ARRAY AND A SUBSTRATE IN A PRINTING DEVICE

CROSS-REFERENCE TO RELATED APPLICATIONS

This application is a Continuation of copending PCT International Application No. PCT/EP2009/056282 filed on May 25, 2009, which designated the United States, and on which priority is claimed under 35 U.S.C. §120. PCT International Application No. PCT/EP2009/056282 claims priority to Application No. 08156803.2, filed in Europe on May 23, 2008. The entire contents of each of the above-identified applications are hereby incorporated by reference.

BACKGROUND OF THE INVENTION

1. Field of the Invention

The present invention relates to a method for adjusting a recording substrate and at least one array relative to each other, the recording substrate and the at least one array having a relative position with respect to each other, the at least one array being part of a printing device having a carrying structure for mounting said array and having nozzles arranged in a row substantially parallel to a first direction for forming second test marks on the recording substrate, wherein the recording substrate comprises a pre-printed pattern containing first test marks, the method comprising forming a test pattern containing the first and second test marks, each first and second test mark having a location on the substrate, and detecting the locations of the first and second marks.

2. Description of Background Art

In an ink jet printer known from the background art and having at least one printhead, a carriage whereon the printhead is mounted is generally moved over a recording substrate in a main scanning direction parallel to a y-axis for the purpose of recording a swath of an image. The printhead has at least one array of nozzles extending in a direction substantially parallel to the x-axis, which is the sub-scanning direction. The sub-scanning direction x is perpendicular to the main scanning direction y. An image swath consisting of a certain number of pixel lines, corresponding to the number of activated nozzles of the printhead is thus recorded during a pass of the carriage along the main scan direction. In a given relative position of the array and the substrate along the x-axis, the array and the recording substrate at least partially flank each other and are arranged for applying second test marks (also referred to as dots) on a substrate, which is pre-printed by first test marks. Some pixel lines are thus constituted by the second test marks, corresponding to the nozzles of the array, while other pixel lines are constituted by first test marks which are pre-printed on the recording substrate. The first test marks form a pre-printed pattern already present on the recording substrate before printing the second test marks. The pre-printed pattern may be printed on the substrate with the same printing device or another printing device. The pre-printed pixel lines are thus constituted on the recording substrate by the first test marks, which together with the printed second test marks form a test pattern. Generally, interlacing of the pixel lines constituted by the first test marks and pixel lines constituted by the second test marks is desired to obtain a high resolution of the recording image and the spacing between the lines should be as regular as possible. During one single pass of the carriage over a pre-printed recording substrate, a printing resolution twice as high as the resolution of the single array may be achieved. Therefore, the locations of the first and second test marks should be compared and analyzed in order to determine the relative position of the array and the substrate along the x-axis. The determined relative position may have to be adjusted to reach a high degree of precision in the desired relative positioning of the substrate and the array. Deviations in the test pattern may be detected and may be used to adjust the relative position of the array and the substrate. Furthermore, a common error in the positioning of pixels is caused by jet angles which deviate from the ideal jet angle. Such defects may be caused by impurities present in the nozzles. Such defects may lead to deviations between the positioning of the first and second marks. Deviations in positioning of a first test mark may be caused during pre-printing of the first test marks on the substrate and deviations in positioning of a second test mark may be caused during printing of the second test marks by the array on the pre-printed substrate. Such defects may lead, for graphical applications, to the appearance of white or light stripes in an image, known as a "banding" effect. When inkjet technology is applied as a manufacturing technique for printed electronics, for example, the number of positioning errors must be extremely minimized towards zero.

From DE 19829280A1, a method is known for determining a relative position of a first and a second imaging device. The method includes setting an image of a reference pattern by the first imaging device on a recording substrate, setting an image of a reference pattern by the second imaging device on the same part of the recording substrate, resulting in a combination pattern. The relative position of the first and second image device can be determined from the combination pattern.

From U.S. Application Publication No. 2003/0144815, another method is known wherein the relative position of two patterns printed by a first and a second image device is determined by means of a basic pattern being already present on a recording substrate before the setting of the images by the first and second image device.

SUMMARY OF THE INVENTION

The object of the present invention is to improve a method for adjusting at least one array and a recording substrate relative to each other in a printing device, such that interlaced pixel lines can be obtained with a regular spacing between the pixel lines. With a regular spacing between pixel lines, the phenomenon of "banding" is significantly reduced.

This object is achieved by a method for adjusting at least one array and a recording substrate relative to each other in a printing device, further comprising determining a plurality of deviation factors for a plurality of attainable relative positions based on said detected locations, wherein each one of said deviation factors is an attribute of a distinct attainable relative position and is indicative of an amount by which distances between neighboring first and second test marks deviate from a nominal distance, and selecting an attainable relative position among the plurality of attainable relative positions which satisfies a selection criterion applied to the plurality of deviation factors.

Since a deviation factor which is an attribute of an attainable relative position is determined, the defects that would appear in the spacing between lines comprising first test marks and lines comprising second test marks can be quantified for the corresponding attainable relative position. The deviation factor is characteristic of an amount by which distances between pixel lines deviate from a nominal distance. Deviation factors are determined for a plurality of attainable relative positions. Thus, for each of said attainable positions, the defects that would appear in a printed image are quantified. This enables the selection of an attainable relative position which is the optimum attainable relative position of the array and the recording substrate. To select the optimum attainable relative position, a selection criterion is applied to the plurality of deviation factors attributed to the plurality of attainable relative positions.

In one embodiment of the method according to the present invention, the selected attainable relative position is the one having the smallest deviation factor among the plurality of deviation factors. With such a selection criterion, the selected attainable relative position leads to printed images, wherein the appearance of the defects such as caused by deviating jetting angles is minimized.

In another embodiment of the method according to the present invention, a maximum function constrains the deviation factor attributed to a distinct attainable relative position to take the value of the largest difference, in absolute value, among an ensemble of differences computed between the nominal distance and the distances between neighboring first and second test marks. The use of this maximum function in order to set the deviation factor leads to the selection of an attainable relative position, wherein large spacing between pixel lines in a printed image is avoided. This embodiment is particularly interesting for applications directed to printed electronics, such as printing etch-resist, where maximum deviations in a printed pattern must be minimized and are more important than uniform distributions in droplet positioning. When this method is applied, reliable printed circuit boards are obtained.

In yet another embodiment of the method according to the present invention, an average function constrains the deviation factor attributed to a distinct attainable relative position to take the value of an averaged difference, computed in absolute value between the nominal distance and the distances between neighboring first and second test marks. The use of this average function in order to set the deviation factor leads to the selection of an attainable relative position wherein the averaged spacing between pixel lines is as close as possible to the nominal value. This is particularly of interest for graphical applications and leads to printed images with a good uniformity of the pixel distribution.

In still another embodiment of the method according to the present invention, a maximum function constrains the deviation factor attributed to a distinct attainable relative position to take the value of the largest difference between the nominal distance and the distances between neighboring first and second test marks. With this maximum function, an attainable relative position may be selected which leads to printed images wherein the image banding is strongly reduced.

In a preferred embodiment, the method according to the present invention further comprises the step of displacing at least one of the array and the recording substrate for bringing the array and the recording substrate into the selected relative attainable position. Once this step is carried out, the array and the recording substrate are positioned relative to each other such that printing under optimal conditions may start. This method may be applied from time to time, in order to calibrate a printing device comprising an array provided with a recording substrate. Alternately, the method may be applied before a new substrate is used on the printing device or even before every printing session.

The invention also relates to a printing device comprising an array mounted on a carrying structure, the array having nozzles arranged in a row substantially parallel to a direction for forming first marks on a recording substrate comprising a pre-printed pattern containing first test marks, wherein in an attainable relative position, the array moves along the recording substrate, a displacement device is configured to displace at least one of the array and the recording substrate thereby causing a change in the attainable relative position and a control unit is configured to control the array for applying second test marks on the recording substrate forming a test pattern, each first and second test mark having a location on the recording substrate, and to control a detector that detects the locations of the first and second marks.

A printing device of the type set forth may be used for special applications such as printed electronics, for which a high accuracy of the placements of the marks on the recording substrate is essential. Indeed, errors in the relative positions of printed lines lead to the occurrence of conductive tracks having errors in spacing widths. This may cause insufficient electrical isolation between adjacent tracks. The second marks already printed on the substrate as a reference pattern may be precisely overlapped by the second marks printed by the array.

Moreover, in such applications, a configuration is possible wherein besides the array, a second array is mounted on the same print head, which at least partially flanks the first array, such that the first array is normally used for printing purposes, while the second array is used for backup purposes in the case that malfunctioning of some nozzles of the first array is detected. When this happens, the malfunctioning nozzles of the first array can be set in an inactive state, while nozzles of the second array take over their function. In this kind of application, it is essential that the marks, formed by the second array, come to lie on the recorded substrate at substantially the same locations as the first marks formed by the first array, if the first array was functioning properly. The printing devices of the background art have the problem that the marks formed by the second array are not positioned properly with respect to the desired locations.

The object of the present invention is to improve a printing device of the type set forth such that these problems are minimized.

This object is achieved in a printing device having a control unit configured to control a computing module for executing the steps of determining a plurality of deviation factors for a plurality of attainable relative positions based on said detected locations, wherein each one of said deviation factors is an attribute of a distinct attainable relative position and is indicative of an amount by which distances between neighboring first and second test marks deviate from a nominal distance, and selecting an attainable relative position among the plurality of attainable relative positions which satisfies a selection criterion applied to the plurality of deviation factors.

Since a deviation factor, which is an attribute of an attainable relative position, is determined, the defects that would appear in the spacing between lines comprising first test marks and lines comprising second test marks can be quantified for the corresponding attainable relative position. The deviation factor is characteristic of an amount by which distances between pixel lines deviate from a nominal distance. Deviation factors are determined for a plurality of attainable relative positions. Thus, for each of said attainable positions, the defects that would appear in a printed image are quantified. This enables the selection of an attainable relative position which is the optimum attainable relative position of the array and the recording substrate. To select the optimum attainable relative position, a selection criterion is applied to the plurality of deviation factors attributed to the plurality of attainable relative positions.

In one embodiment of the printing device according to the present invention, the control unit is configured to control the displacement device for causing the array and the recording substrate to have a selected attainable relative position. This enables a calibrating procedure for adjusting the array and the recording substrate relative to each other, which may easily be executed automatically, for example before each time an image is to be printed.

In another embodiment of the printing device according to the present invention, the detector is a CCD camera mounted on a carriage and arranged for scanning the test pattern. Preferably, the CCD camera is arranged for determining a geometrical center of gravity of each one of the first and second test marks in the test pattern and extracting coordinates of said first and second test marks along an axis. With such a CCD camera, the locations of the test marks in the test pattern can be accurately determined. Moreover, with the extracted coordinates, the distances between neighboring first and second test marks can be also accurately extracted. This leads to determined deviation factors which characterize properly the defects in an image depending on the attainable relative position.

In yet another embodiment of the printing device according to the present invention, the nozzles of the array are regularly spaced according to a pitch and the pixel lines constituted by the first test marks are regularly spaced according to the same pitch. This is useful for many applications, such as high resolution graphical applications or printed electronics applications. When the nominal distance is equal to half the pitch, printing with a double resolution may be achieved with a good quality. When the nominal distance is equal to zero, a printing device for printed electronics with a high reliability can be achieved, since a second array can serve as a backup array in the event that some nozzles in the first array have to be set inactive due to their malfunctions.

In another embodiment, the nozzles of the at least one array are regular spaced according to a pitch, and a displacement of the at least one array to obtain the selected attainable relative position does not only comprise a translation of the print head in the first direction (X), but also comprises a rotation of the print head over such an angle that the pitch multiplied by the cosine of the angle equals the distance between neighboring first test marks on the recording substrate in the first direction (X). The plurality of attainable relative positions may even comprise every combination of an attainable rotation and an attainable translation of the at least one array. Among the plurality of attainable relative positions, one attainable relative position is selected being a result of a specific combination of rotation and a translation which satisfies the selection criterion applied to the plurality of deviation factors. This gives more flexibility in the case that a rotation of the at least one array is needed to get an optimal distance between neighboring second test marks in the first direction (X). This is particularly advantageous when the nominal distance between neighboring first test marks does not equal the pitch of the nozzles of the at least one array.

The present invention also relates to a computer program product residing on a computer readable medium comprising instructions for causing at least one process unit to perform the method of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 is a schematic representation of a recorded test pattern comprising test marks, together with the normal projection of the marks onto the x-axis;

FIG. 6 is a table which associates an x-coordinate to each recorded mark of the test pattern shown in FIG. 4;

FIGS. 7A and 7B list the distances between adjacent first and second points that would arise if the array and the recording substrate were in the relative position 1 (FIG. 5A) and in the relative position 3 (FIG. 5C), respectively;

FIG. 11 shows cross-sectional views of the recording substrate and the array in a relative position suited for printing overlapping pixel lines;

FIG. 12A illustrates an arrangement of marks for graphical applications;

FIG. 12B illustrates an arrangement of marks for special applications such as printing etch-resist ink and/or conductive material for printed circuit board manufacturing.

DETAILED DESCRIPTION OF THE PREFERRED EMBODIMENTS

Figure 1:
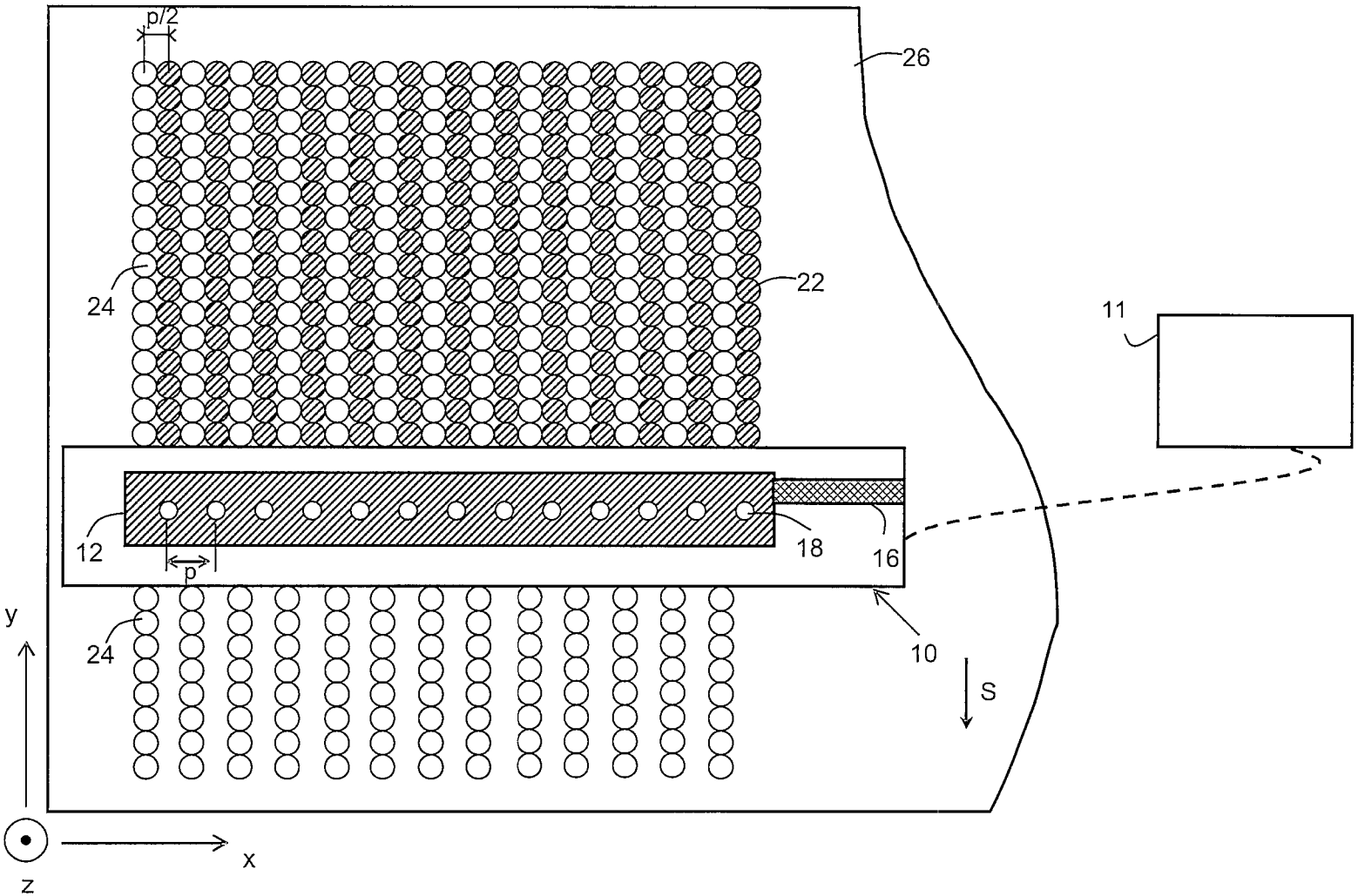
FIG. 1 is a schematic view of essential parts of a printing device having a printhead with one array, together with an ideal mark pattern pre-printed on a recording substrate.

The present invention will now be described with reference to the accompanying drawings, wherein the same reference numerals have been used to identify the same or similar elements throughout the several views.

FIG. 1 schematically shows a carriage 10 of an ink jet printer having a printhead which is mounted on the carriage 10. The printhead has an array 12 of nozzles 18 aligned in a row. Although only one array 12 is shown in the drawing, it is possible to mount additional arrays on the carriage 10. The array 12 may be suited for recording marks of the same marking substance, such as black ink or an etch-resist ink suited for printed electronics applications. The arrays 12 may also be suited for recording marks of different marking substances such as a conductive material and an etch-resist material. With even more arrays, a full color printer may be obtained, whereby the plurality of additional arrays is used for printing the colors yellow, cyan and magenta. The method for adjusting one array and a recording substrate such as described hereinafter easily translates to more than one array.

The array 12 may be of any type suited for ejecting ink droplets according to a recording signal. A known ink jet printhead with an array of nozzles is provided with a plurality of pressure chambers each of which is fluidly connected on the one hand, via an ink supply path, to an ink reservoir and on the other hand to a nozzle, wherein an actuator is provided for each pressure chamber for pressurizing the ink contained therein, so as to eject an ink droplet through the nozzle in accordance with a recording signal supplied by a control unit. The nozzles are arranged in a row, so that a plurality of pixel lines of an image can be recorded simultaneously. The actuators may be formed by piezoelectric or thermal elements that are arranged along each ink channel. When an ink droplet is to be expelled from a specific nozzle, the associated actuator is energized so that the liquid ink contained in the ink channel is pressurized and an ink droplet is ejected through the nozzle.

The array 12 is provided with a row of nozzles 18, which row extends in a so-called sub-scanning direction which is parallel to an x-axis. The sub-scanning direction is the direction in which a recording substrate 26 (such as a sheet of paper) is advanced step-wise. In order to print a swath of an image, the carriage 10 is moved across the substrate 26 in a main scanning direction parallel to a y-axis, normal to the x-axis. The control unit 11 is connected to the printhead with the array 12 and is arranged for supplying recording signals to the printhead so as to activate image-wise the nozzles.

The carriage 10 has an element 16 configured for adjusting the relative position of the array 12 and the substrate 26 along the x-axis. The element 16 is mechanically connected to the printhead in order to displace the array along the x-axis such that the relative position of the array 12 and the substrate 26 is modified. The element 16 may be a piezoelectric element adapted to expand and retract along the x-axis, in response to electrical signals supplied by the control unit 11. The substrate is guided via a substrate table (not shown). The substrate table may also be provided with an element configured for adjusting the relative position of the substrate 26 and the array 12 along the x-axis. The substrate table may be positioned to the print head in a selected relative position.

In the example shown in FIG. 1, the nozzles 18 of the array 12 are spaced from one another according to a substantially constant pitch p. First pixel lines containing first test marks 24 are pre-printed on the recording substrate and are regularly spaced according to the same pitch p. The array 12 is suited for printing test marks (or dots) 22, which result from the ejection of ink droplets out of the nozzles 18, with a resolution along the x-axis substantially equal to 1/p (usually expressed in dots per inch). As is seen in FIG. 1, second pixel lines having second test marks 22 are formed on the recording substrate 26 and extend along the y-axis. On the recording substrate 26, the first test marks 24 have the same resolution. The second pixel lines having second marks 24 and extending along the y-axis are already present on the substrate 26 before printing with the array 12 is started. When the array 12 and the substrate 26 are relatively aligned such that the nozzles 18 are in a longitudinal staggered arrangement, a pattern with alternating first and second lines such as shown in FIG. 1 may be obtained, with printing resolution substantially equal to 2/p. To achieve this printing resolution in an image swath with one single pass of the carriage 10, represented by the arrow S, the array 12 is activated image-wise within one single carriage pass. In FIG. 1, a pattern extending along the y-axis is represented, whereby all possible nozzles of the array 12 are activated. However, in practice, the array 12 is driven by the control unit 11 in order to activate the nozzles image-wise. For applications such as printed electronics, initially before printing lines may be recorded on the substrate 26 using a special etch-resistant ink in order to later on produce tracks of a conductive material by means of an etching process carried out by nozzles of the array 12.

Figure 2A:
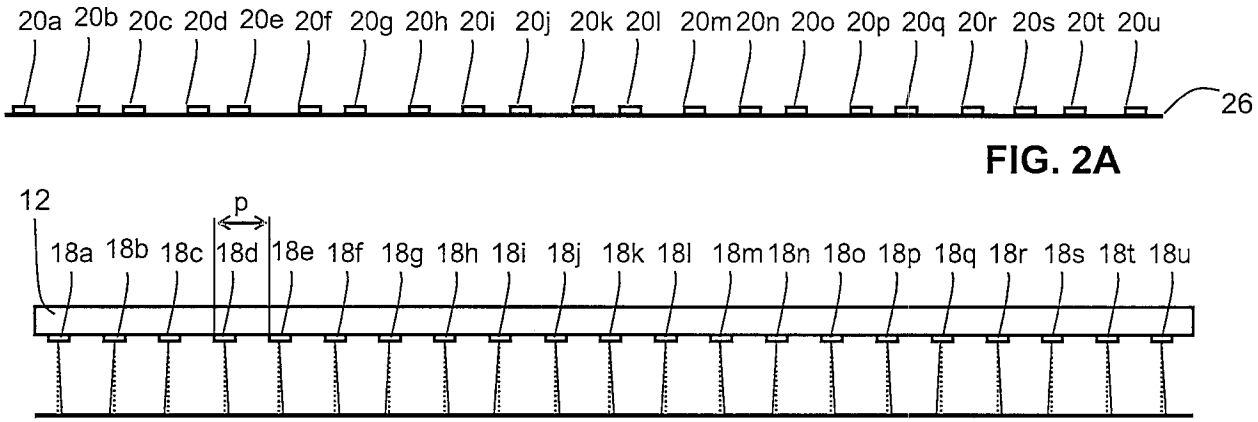
FIG. 2A is a cross-sectional view of the recording substrate that shows the deviation of the first test marks pre-printed on the recording substrate.
Figure 2B:
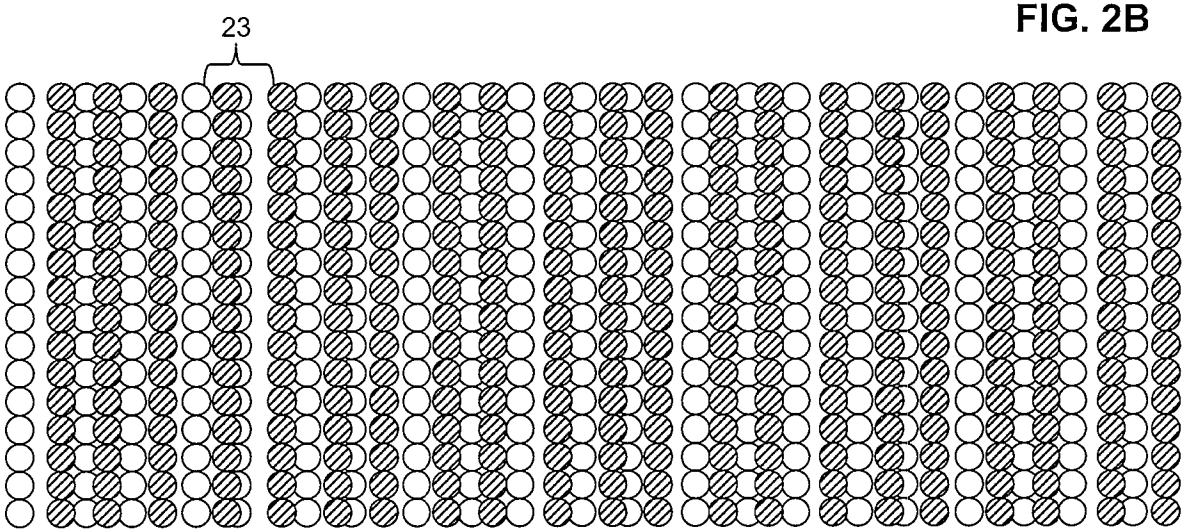
FIG. 2B is a cross-sectional view of the array that shows the deviation of the jet angles associated to each nozzle of the array.
Figure 3:
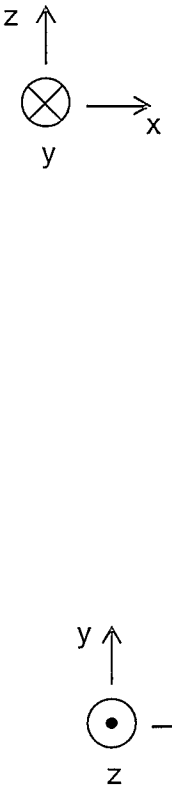
FIG. 3 is a schematic representation of a printed pattern when the array is not yet aligned with the recording substrate.

The recorded pattern with the test marks 22 and 24 such as represented in FIG. 1 is however unrealistic, and in practice, a recorded pattern is imperfect. A source of defaults lies within the fact that jet angles considered in the x-z plane deviate from the ideal jet angle of 90 degrees. Deviations of jet angles from the ideal jet angle are illustrated schematically for the nozzles 18 of the array 12 in FIG. 2B. On the other hand, the test marks 24, which were already present on the recording substrate 26 before printing, could have deviations for example due to the same reason of jetting deviations. The first test marks 20*a*-20*u* may have been positioned on the recording substrate 26 as shown in FIG. 2A. In the drawing, the array 12 is represented according to a cross section and the relative position of the array 12 and the substrate 26 is assumed to be the same as is shown in FIG. 1. In the rest of the description, the situation is described wherein the array has 21 nozzles (18*a* . . . 18*u*), but in reality, an array may comprise much more nozzles. Some nozzles (for example 18*b*, 18*c*, 18*g* etc) eject droplets according to a trajectory having a medium deviation to the left. First test marks (for example 20*e*) have a major deviation to the left. Yet other nozzles have a minor deviation to the right (for example 18*a*, 18*d*, 18*e* etc). Yet other first test marks have a minor deviation to the right (for example 20*b*, 20*d*, 20*f*) The fact that the jet angles deviate from the ideal angle may cause banding in a recorded dot pattern, as is shown in FIG. 3. At some locations of the pattern, undesired empty (or 'white') lines appear while at some other locations, undesired dark lines appear due to overlapping. These defects are particularly pronounced in an area 23, wherein a strong overlap as well as a large spacing between vertical lines are visible. The phenomenon of banding is visually unpleasant. For printed electronics application, this leads to isolation problems between conductive tracks.

Figure 10:
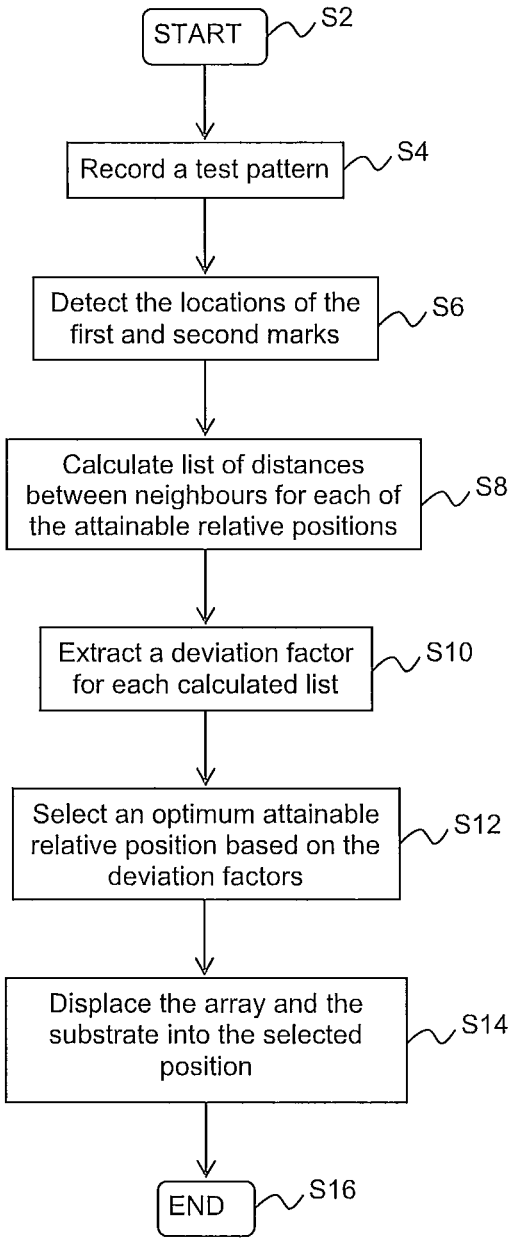
FIG. 10 is a flow diagram representing the steps of a method according to an embodiment of the present invention.

A method for adjusting the array and the substrate relatively to each other according to an embodiment of the present invention is now described with reference to the flowchart diagram of FIG. 10. The steps of the method may be automated. For this purpose, the control unit 11 is adapted to issue instructions to different modules such as described hereinafter. To perform its tasks, the control unit 11 comprises, for example, a processor, a first memory such as a RAM, whereon data may be written during the adjusting procedure and a second memory such as an EPROM for storing instructions executable by the processor. Alternately, the procedure may be carried out semi-automatically or manually.

In a first step S2, the adjusting procedure is started by a user in order to launch a program for adjusting the relative position of the array and the substrate which may be installed on the control unit 11.

In step S4, the control unit 11 issues an instruction to the printing device for recording a test pattern on the recording substrate, which recording substrate is already provided with a pre-printed pattern. In step S4, the array and the recording substrate are arranged according to an initial relative position, such as shown in FIGS. 2A and 2B. An example of a suitable test pattern is shown in FIG. 4. The test pattern is obtained by activating all nozzles of the array such that each nozzle expels at least one ink droplet for forming second test marks on the recording substrate. The recording substrate is pre-printed in such a way that each position 20*a*-20*u* (See FIG. 2A) contains at least one ink droplet forming a first test mark on the recording substrate. When the test pattern shown in FIG. 4 is formed, the array 12 and the substrate 26 are in the initial position and the carriage 10 is immobile. The recorded test pattern comprises a group of second test marks 22*a* . . . 22*h* . . . 22*j*, etc. and a group of first test marks 24*a* . . . 24*h* . . . 24*j*, etc. whereby both groups extend in a direction parallel to the x-axis. Alternately, to record a test pattern, the array 12 and the substrate 26 are in the initial position and the carriage 10 is moved along the y-axis in order to form a swath of an image. In this case, when all nozzles are activated while the carriage 10 is moved, pixel lines would be formed on the recording substrate.

In step S6, the control unit 11 issues an instruction to opto-electronic sensors such as a CCD camera (not shown) in order to generate data suited for detecting the locations on the substrate of the first and second test marks of the test pattern. The CCD camera (not shown) may be installed on the carriage 10 of the printing device and is suited for scanning optically the test pattern. The scanned test pattern may then be saved in a suitable image format onto the first memory for further analysis by the control unit 11. Based on the scanned pattern, which is an image comprising data representing the first and second test marks, the location of the first and second test marks are determined by an image analysis software module running on the control unit 11. As is represented in FIG. 4, a normal projection of the recorded second test marks defines points having x-coordinates (x22*a* . . . x22*h* . . . x22*i*, etc.). Similarly, a normal projection of the recorded first test marks defines points having x-coordinates (x24*a* . . . x24*h* . . . x24*i* etc). Based on the determined locations of the first and second test marks, the analysis module of the control unit 11 extracts the x-coordinates of the points and generates a list of x-coordinates corresponding to the recorded first and second test marks. An example of such a list is represented in FIG. 6. Alternately, the CCD camera may be provided with a micro-processor for performing the tasks of determining the locations of the first and second test marks and extracting the x-coordinates. In this case, the CCD camera is preferably arranged for determining a geometrical center of gravity of each recorded test mark. The determination of the centers of gravity leads directly to the x-coordinates (such as exemplified in FIG. 6) which are transmitted by the CCD camera to the control unit 11 via a connection device.

Figure 5A:
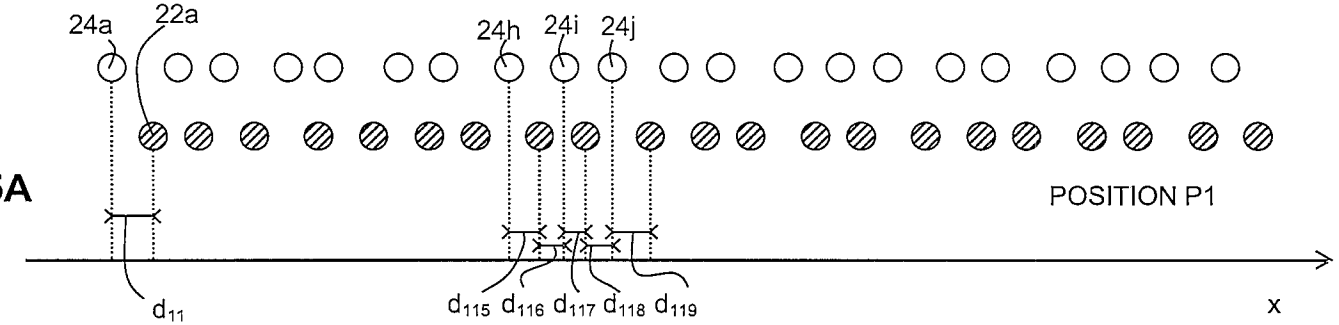
FIGS. 5A to 5F represent marks pattern that would be obtained in six different attainable relative positions of the array and the recording substrate.

The concept of 'an attainable relative position' is now elucidated. An attainable relative position is a position wherein the array and the pre-printed pattern on the recording substrate at least partially flank each other, thereby defining a degree of a longitudinal overlap along the x-axis. The array, in an attainable relative position to the recording substrate, could record a pattern with alternating pixel lines comparable to the initial pattern of FIG. 3, except the fact that the recorded pattern would be less wide in the x-direction since the nozzles falling outside the overlapping area would not be usable anymore. Said nozzles are not usable anymore because the resolution would not be acceptable anymore compared to the desired resolution. Indeed, the nozzles falling outside the overlapping area would produce a print resolution equal to 1/p while the nozzles falling within the overlapping area would lead to a resolution equal to 2/p, which is in the example the desired resolution. If the array 12 and the recording substrate 26 were brought into a certain attainable position and all nozzles of the array 12 were activated and all first test marks are present on the pre-printed recording substrate, the recorded mark pattern would be as is illustrated in FIG. 5A for position P1, in FIG. 5B for position P2, in FIG. 5C for position P3, in FIG. 5D for position P4, in FIG. 5E for position P5 and in FIG. 5F for position P6. The position P1 simply corresponds to the initial position and the degree of longitudinal overlap is 100%. All nozzles may be used to record a pattern. Position P2 corresponds to a position wherein the array and the recording substrate have been relatively displaced along the x-axis by a distance equal to one pitch p. The degree of longitudinal overlap is about 95%. The outermost left test mark on the pre-printed recording substrate, i.e. on the position 20*a* is not usable anymore in further calculations. The outermost right nozzle of the array 12, i.e. the nozzle 18*u* is also not usable anymore and is not needed to print a test mark. Position P3 corresponds to a position wherein the arrays have been relatively displaced along the x-axis by a distance equal to two pitches (2*p*). The degree of longitudinal overlap is about 90%. The two outermost left test marks on the pre-printed substrate, i.e. on the positions 20*a* and 20*b* are not usable anymore in further calculations. The same holds for the two outermost right nozzles of the array 12, i.e. the nozzles 18*u* and 18*t*. In position P4 (see FIG. 5D), the nozzles 18*u*, 18*t* and 18*s* and the positions 20*a*, 20*b*, 20*c* are not usable anymore. In position P4, the degree of longitudinal overlap is about 85%. In position P5 (see FIG. 5E), the nozzles 18*u*, 18*t*, 18*s* and 18*r* and the positions 20*a*, 20*b*, 20*c*, 20*d* are not usable anymore. In position P5, the degree of longitudinal overlap is about 80%. Finally, in position P6 (see FIG. 5F), the nozzles 18*u*, 18*t*, 18*s*, 18*r* and 18*q* and the positions 20*a*, 20*b*, 20*c*, 20*d*, 20*e* are not usable anymore. In position P6, the degree of longitudinal overlap is about 75%. The number of attainable positions may be freely chosen, and depends mainly on the design of the arrays and on choices made for an acceptable minimum print width.

Ideally, the projected distance onto the x-axis between adjacent first and second marks should be equal to a nominal distance. In the present example, the nominal distance is equal to half the pitch p. Here, the pitch p is supposed to be equal to 80 arbitrary units (a.u.) Therefore, the projected distance between adjacent first and second marks should ideally be equal to 40 a.u (the nominal distance). In step S8, a list of distances between first and second neighboring marks is computed by the control unit 11 for each one of the attainable relative positions of the array and the substrate. The term 'neighboring marks' relates to first and second marks which are located next to each other. A distance between first and second neighboring marks may be the projected distance onto the x-axis that would arise between adjacent first and second points if the array and the substrate were brought into one of the attainable relative positions. In FIGS. 5A to 5F, a number of distances between first and second neighboring marks are illustrated. For example, for the position P1 shown in FIG. 5A, $d_{11}$ is the projected distance between the first mark 24*a* and the second mark 22*a*. The distance $d_{11}$ is simply obtained by the relationship $d_{11}$=x22*a*−x24*a*. In this position P1, other examples of relationships are the following: $d_{115}$=x22*h*−x24*h*; $d_{116}$=x24*i*−x22*h* and so on. Hence, based on the x-coordinates represented in the table in FIG. 6, a list $L_1$ of distances between first and second neighboring marks is computed for the relative position P1 and is illustrated in FIG. 7A.

Figure 5B:
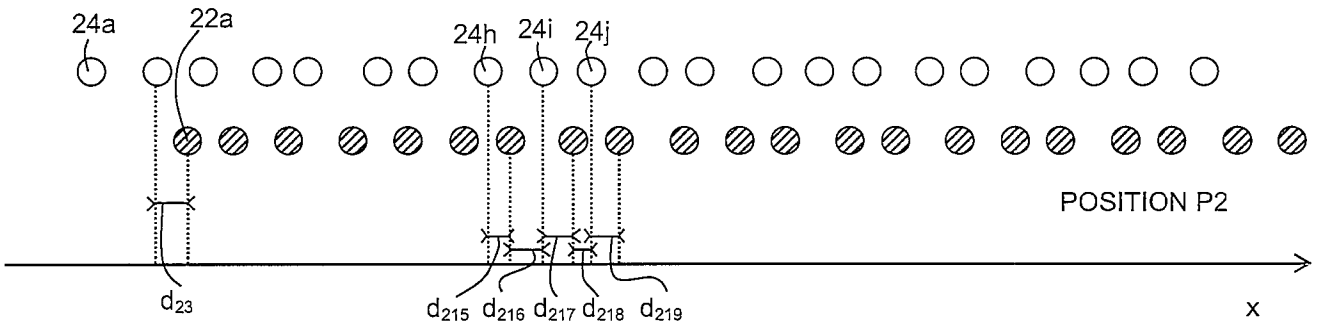
Figure 5C:
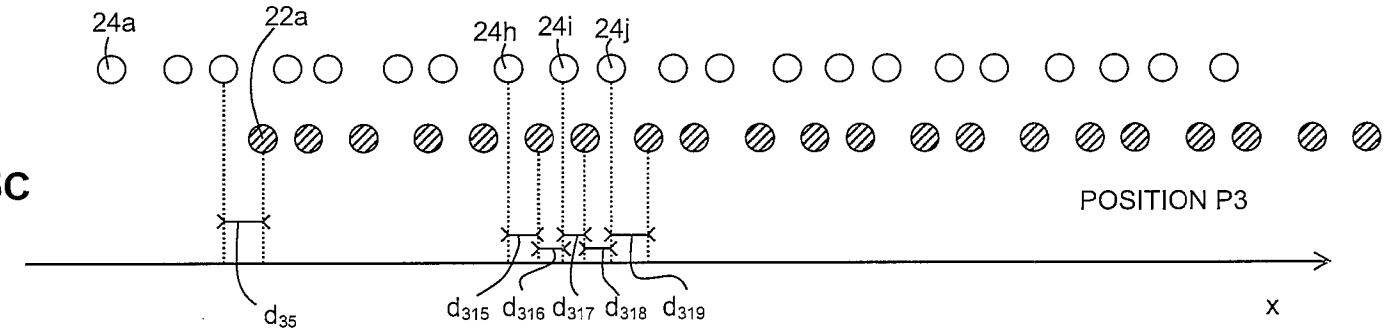
Figure 5D:
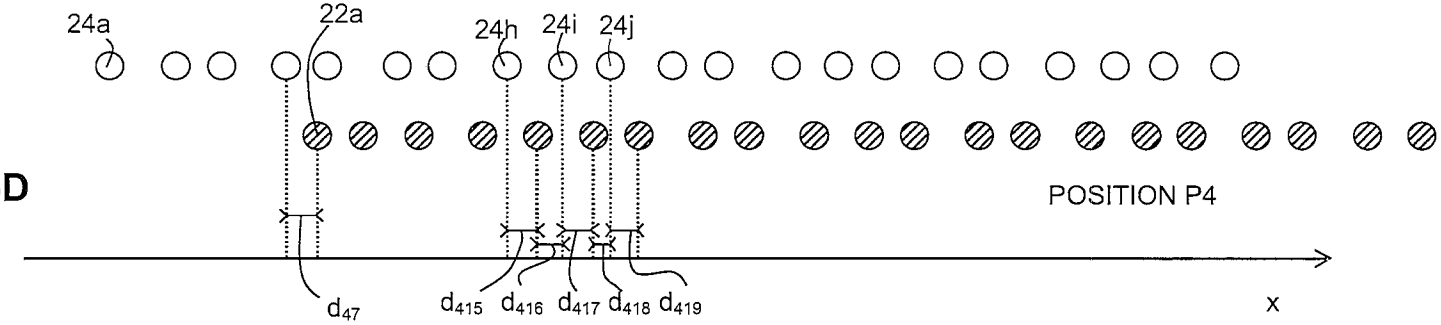
Figure 5E:
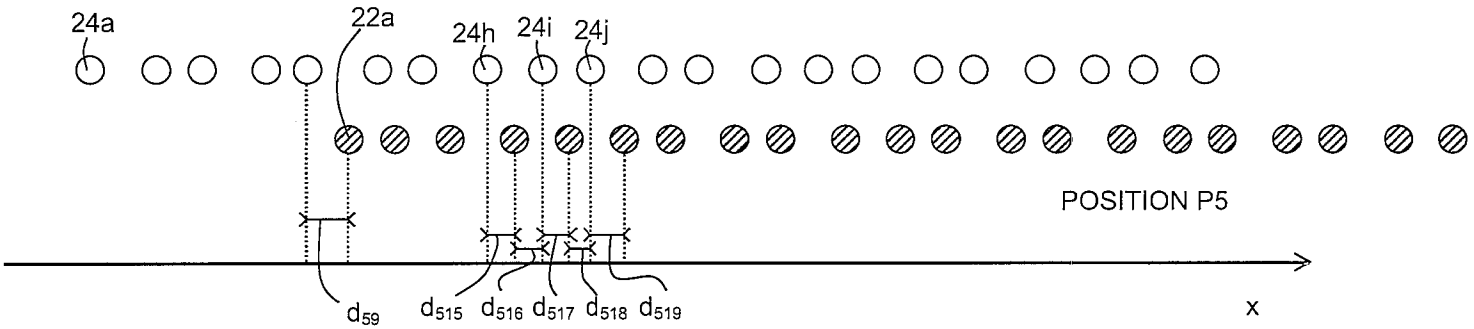
Figure 5F:
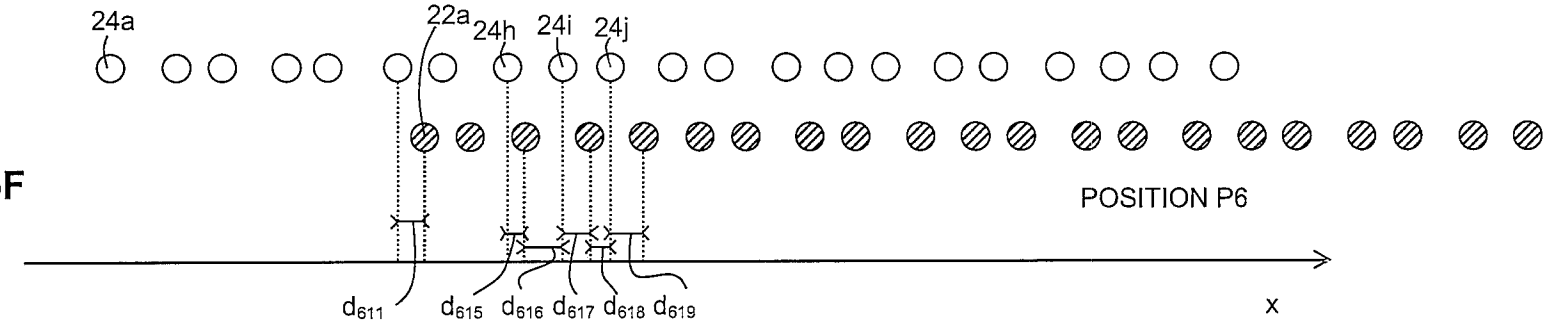

In step S8, a list of distances between first and second neighboring marks is also computed for the position P2 (see FIG. 5B). Since the position 20*a* is not usable anymore and since the relative position is shifted by a distance equal to one pitch p, the first distance of the list for the position P2 is $d_{23}$, the projected distance between the second mark 22*a* and the first mark 24*b*. Due to the shift by one pitch, $d_{23}$ is obtained by the following relationship: $d_{23}$=x22*a*+p−x24*b*. Other examples are $d_{215}$=x22*g*+p−x24*h*; $d_{216}$=x24*i*−x22*g*-*p* and so on.

In step S8, similarly, a list of distances between first and second neighboring marks is also computed for the position P3. Now, the test marks 24*a* and 24*b* are not usable anymore, since the relative position of the array and the recording substrate is shifted by a distance equal to two pitches (2*p*) compared to the initial position. The first distance of the list corresponding to the position P3 is then $d_{35}$ which is given by the following relationship $d_{35}$=x22*a*+2*p*−x24*c*. Other examples in the position P3 are $d_{315}$=x22*f*+2*p*−x24*h*; $d_{316}$=x24*i*−x22*f*−2*p* and so on. Based on the x-coordinates represented in a table in FIG. 6, a list $L_3$ of distances between first and second neighboring marks is computed for the relative position P3 and is illustrated in FIG. 7B.

Once a list of distances between first and second neighboring marks has been calculated for each one of the attainable positions P1, P2, P3, P4, P5 and P6, the program running on the control unit 11 proceeds to step S10.

In step S10, a so-called deviation factor F is extracted by control unit 11 for each one of the list of distances. The deviation factor F is an attribute of the relative position (P1 or P2 or P3 etc.) and is indicative of an amount by which distances between first and second neighboring marks deviate from the nominal distance. A deviation factor is actually indicative of an amount by which the distances in a list (in $L_1$ or $L_3$, for example) deviate from the nominal distance. As explained above, the nominal distance may be the projected distance onto the x-axis between adjacent first and second marks in the ideal case. The nominal value is in the present example equal to half the pitch of the nozzles in a row, i.e. 40 a.u. It is seen in the list $L_1$ of FIG. 7A that some distances between first and second neighboring marks deviate significantly from the nominal value of 40 a.u. The differences Δn computed between the nominal distance and the distances between neighboring first and second marks are exemplified in the second part of the list $L_1$ and $L_3$. For example, the difference $\Delta_{11}$ is obtained by the following relationship $\Delta_{11}=40-d_{11}$, wherein 40 is the nominal distance.

A maximum function may constrain the deviation factor attributed to a distinct attainable relative position to take the value of the largest difference, in absolute value, among the ensemble of differences Δn computed between the nominal distance and the distances between neighboring first and second marks. The deviation factor for a given list (corresponding to an attainable relative position) may thus be equal to the largest Δn found in the list. Indeed, the largest said value(s) is/are, the more visible the defect(s) will be. When the deviation factor for a list is set to be the largest difference, in absolute value, among the ensemble of differences Δn computed between the nominal distance and the distances between neighboring first and second marks, the deviation factor is clearly indicative of a degree of deviation from an ideal situation. The deviation factor $F_1$ for the list $L_1$ (see the greyed area in the list $L_1$ of FIG. 7A) is 30 a.u., corresponding to $\Delta_{19}$. For each list, corresponding to each attainable position, the deviation factor is extracted. For example, the deviation factor $F_3$ for the list $L_3$ (see the greyed areas in the list $L_3$ of FIG. 7B) is 20 a.u. corresponding to a number of difference Δn ($\Delta_{35}$, $\Delta_{310}$, $\Delta_{319}$ etc.).

In the next step (S12), a selection module of the control unit 11 selects a relative attainable position among the plurality of relative attainable positions. The selected relative position has to satisfy a selection criterion which is applied to the deviation factors attributed to the plurality of relative attainable positions. An optimum attainable position is thus selected based on the extracted plurality of deviation factors $F_1 \ldots F_3$, etc. For example, a relative attainable position satisfies the selection criterion when the deviation factor attributed to said relative position is the smallest among the attributed deviation factors. In the example described here, not all lists have been illustrated. However, all lists are computed by the analysis module of the control unit 11 and it appears that the list $L_3$ is characterized by the smallest deviation factor, which is $F_3$ equal to 20 a.u., as indicated above. Therefore, the position P3 (FIG. 5C) appears to be the most favorable relative position for the array 12 and the recording substrate 26. The position P3 is selected by the selection module of the control unit 11.

In step S14, a signal is sent by the control unit 11 to the displacement device 16 for displacing the array 12 thereby bringing the array and the recording substrate in the selected relative position, which is position P3. The array and the substrate are thus shifted from the initial position P1 by a distance equal to two pitches (2*p*).

In step S16, the program is ended. The array and the recording substrate are now in an optimum relative position, and the printing device can be used for recorded patterns. After a certain period, or after a certain amount of recording, the deviation angles associated with the nozzles may evolve. Therefore, the method, as illustrated by the flowchart of FIG. 10, has to be carried out again. Possibly, another relative position will be selected.

Figure 8A:
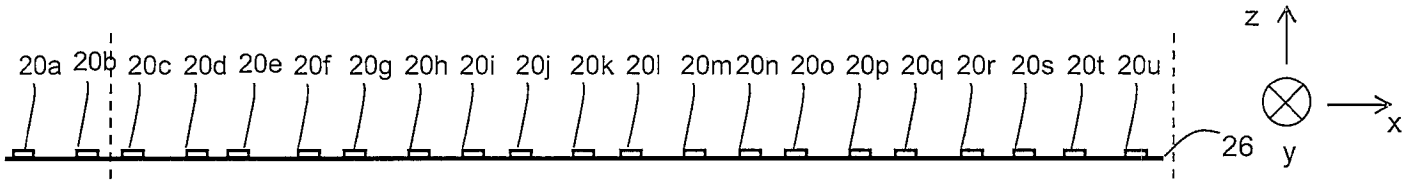
FIG. 8A is a cross-sectional view of the recording substrate and FIG. 8B is a cross-sectional view of the array in the relative position 3.
Figure 8B:
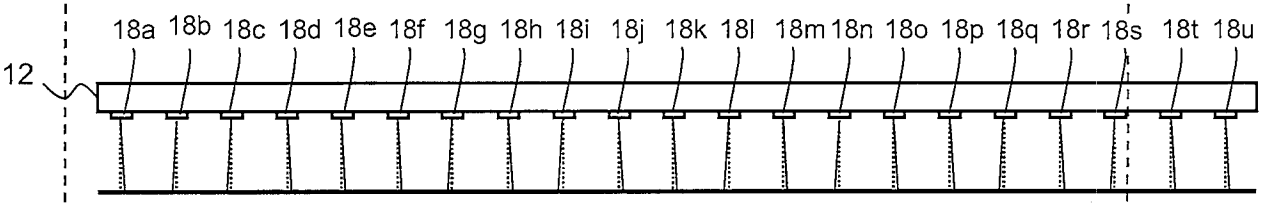
Figure 9:
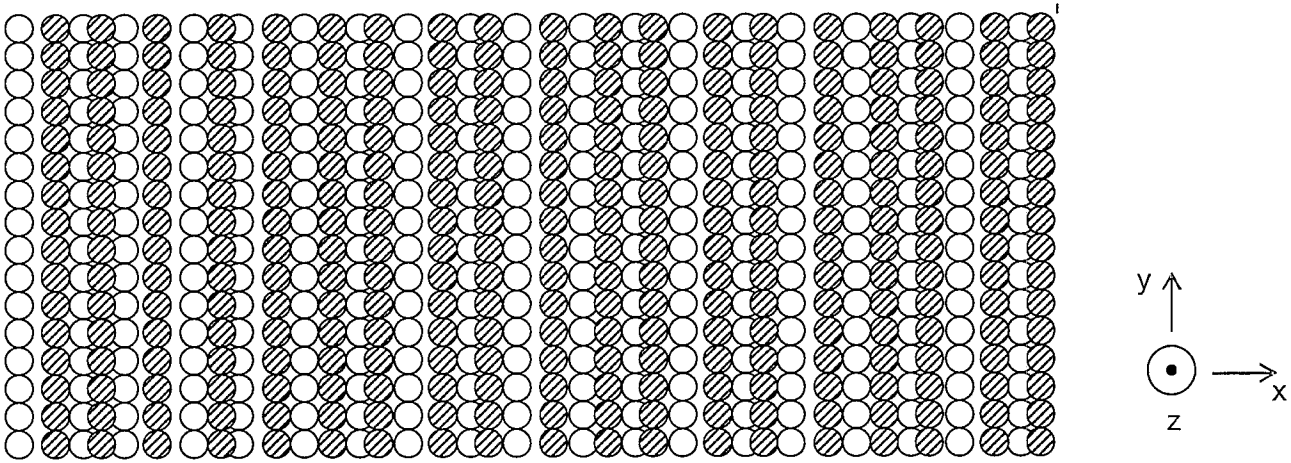
FIG. 9 is a schematic representation of a printed pattern when the array and the recording substrate are aligned according to the method of the present invention.

The position P3 is illustrated by FIGS. 8A and 8B, wherein the array 12 is represented in a cross-sectional view in FIG. 8B and the substrate 26 is represented in a cross-sectional view in FIG. 8A. The overlapping area 28 is also shown. An example of a pattern that may be recorded by the array on the pre-printed substrate in the illustrated arrangement is shown in FIG. 9. As explained above, the locations of the first test marks 20*a* and 20*b* and the nozzles 18*t* and 18*u* are not usable anymore since they find themselves outside of the overlapping area 28. Therefore, the nozzles 18*t* and 18*u* are set inactive by the control unit 11 and the locations of the first test marks 20*a* and 20*b* are not used in further calculations made by the control unit 11. On the other hand, the nozzles 18*a* to 18*s* find themselves within the overlapping area and may be activated image-wise by the control unit. In the case that all of said nozzles finding themselves within the overlapping area are activated to form the pattern shown in FIG. 9, a full recorded surface is obtained. Compared to the pattern shown in FIG. 3, before adjusting the relative position, the phenomenon of banding is less visible. Defects still exist (areas not filled, areas wherein marks overlap) but however, at least one large defect has been suppressed compared to the pattern obtained in FIG. 3. Indeed, the area 23 in FIG. 3 with a large empty band has disappeared in the pattern of FIG. 9.

In the example discussed above, the position P3 appears to be the most advantageous relative position of the array 12 and the substrate 26. In the example illustrated by FIGS. 8A and 8B, eighteen locations of first test marks on the recording substrate and eighteen nozzles from the array find themselves in the overlapping area. The eighteen nozzles are activated image-wise in order to record a pattern. If another position had been found to be optimum, a different number of nozzles would find themselves in the overlapping area. For the position P6 (see FIG. 5F), sixteen locations of first test marks on the recording substrate and sixteen nozzles from the array find themselves in the overlapping area. It might be undesirable to render the number of nozzles to be image-wise activated dependent on the optimum relative position. Instead, a pre-defined number of nozzles for image-wise activation may be chosen. This number may be equal to the number of nozzles finding themselves in the overlapping area when the arrays are in the most shifted possible position. In the example above, that would mean that, independently from the optimum found for the relative position, the number of image-wise to be activated nozzles would be sixteen, i.e. the number of nozzles in the overlapping area when the arrays are in the position P6. If such a choice was made, in the optimum relative position P3, only sixteen nozzles in the overlapping area would be chosen for image-wise activation. The choice may be based again on a best possible relative positioning of the first and second marks within the overlapping area.

Figure 13:
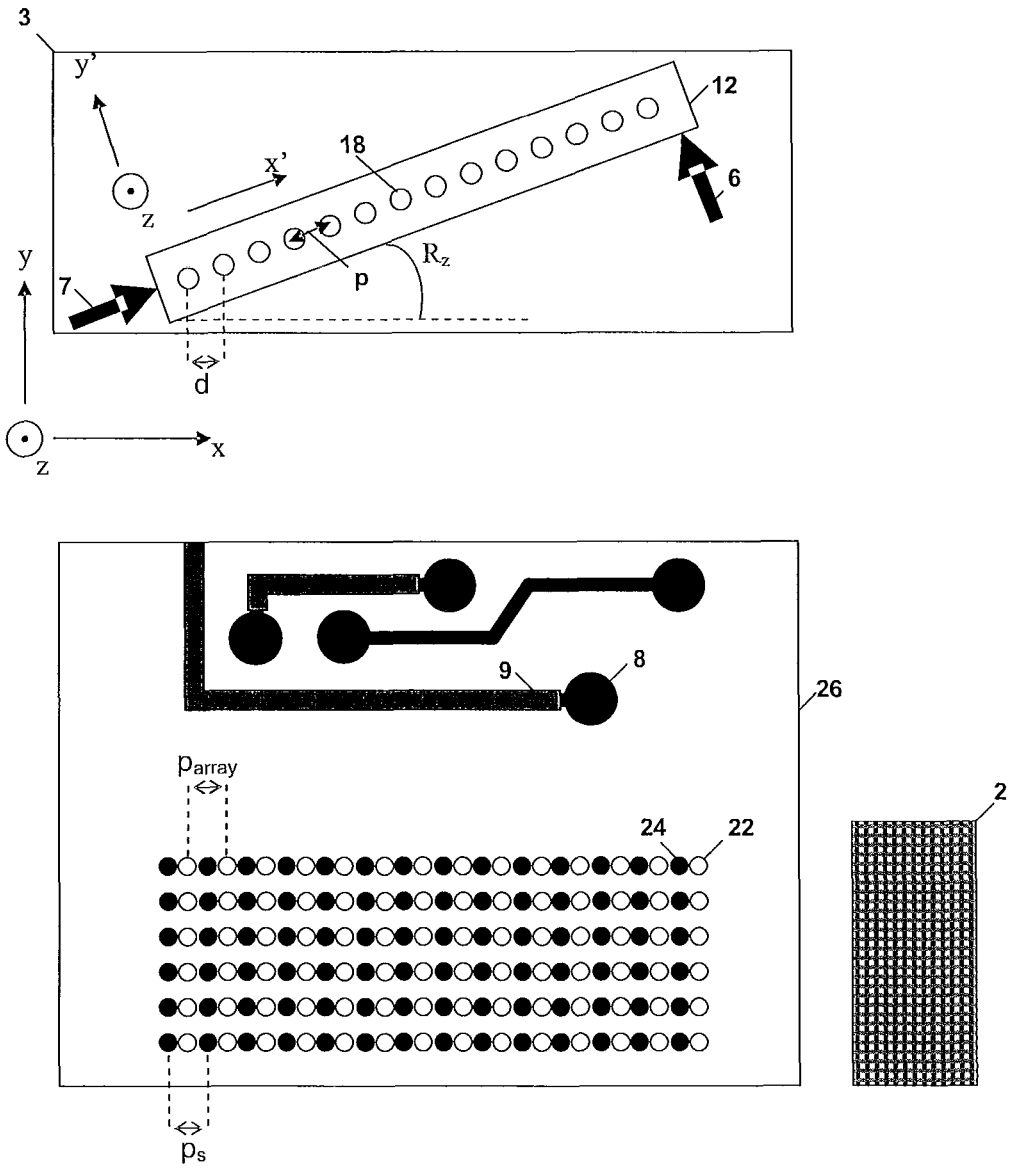
FIG. 13 is a schematic view of essential parts of a printing device having a printhead with one rotated array and a recording substrate containing an ideal pre-printed test mark pattern and a print image.

Another embodiment of the method according to the present invention is illustrated in FIG. 13. Nozzles 18 of an array 12 are regular spaced according to a pitch p and a displacement of the array 12 to obtain an attainable relative position may not only comprise a translation of the array in the first direction (x), but may also comprise a rotation of the array over an angle $R_z$. The angle $R_z$ may be selected such that the pitch p multiplied by the cosine of the angle $R_z$ equals a distance d being substantially equal to a calculated distance $p_s$ of neighboring first test marks 24 on the recording substrate 26 in the first direction (x) and also being substantially equal to a calculated distance $p_{array}$ of neighboring second test marks 22 on the recording substrate 26. The distance $p_s$ may be calculated by averaging all distances of neighboring first test marks 24 on the recording substrate 26 and the distance $p_{array}$ may be calculated by averaging all distances of neighboring second test marks 22 on the recording substrate 26.

The plurality of attainable relative positions may comprise every combination of an attainable rotation and an attainable translation of the array 12. Among the plurality of attainable relative positions an attainable relative position is selected being a result of a specific combination of rotation and a translation which satisfies a selection criterion applied to the plurality of deviation factors. This gives more flexibility in the case that a rotation of the array 12 is needed to get an optimal distance between neighboring second test marks 22 in the first direction (x). This is particularly advantageous when the aimed distance between neighboring first test marks 24 on the recording substrate 26 does not equal the pitch p of the nozzles of the array 12. FIG. 13 illustrates a recording substrate 26 which contains a black-colored substrate image 8 and a pre-printed pattern of first test marks 24. A grey-colored print image 9 has been printed in alignment with the substrate image 8. To achieve the alignment the array 12 with the recording substrate 26 a pattern of second test marks 22 has been printed on the recording substrate 26. The locations of the first and second test marks are measured with a scanner 2.

The print head 3 has an element 6 configured for adjusting an angle $R_z$ of the array 12 and an element 7 for adjusting the position of the array 12 in the first direction (x). The elements 6, 7 may be mechanically connected to the array 12 in order to displace the array 12 along the first direction (x) and to rotate the array 12 along another direction (z). The elements 6, 7 may be piezoelectric elements adapted to expand and retract along the rotated axes (y', x'), in response to electrical signals.

According to FIG. 13, the nozzles 18 of the array 12 have already printed the second test marks 22 and the print image 9. Between printing the second test marks 22 and the print image 9, determining of the locations of the first and second test marks and further calculations as described before can be executed, followed by a possible displacement of the array 12. According to FIG. 13, the displacement of the array 12 comprises a rotation of the array 12 with an angle $R_z$. The print image 9 may be a part of a larger print image realized after more than one print pass. In that case, the test pattern may be only printed once for the larger image, for example during the first print pass.

In another embodiment of the method according to the present invention, the array and the recording substrate are adjusted respectively to each other such that the nominal distance is zero. The adjustment with a nominal distance equal to zero is for example interesting for applications wherein marks formed by ink of a first type have to be printed at the same locations on the recording substrate as marks formed by ink of a second type. In a printing device according to an embodiment of the invention, the nozzles of the array are regularly spaced according to a pitch and the pixel lines of the pre-printed pattern on the recording substrate are regularly spaced according to the same pitch. When the array and the recording substrate are adjusted respectively to each other such that the nominal distance is zero, such as shown in FIG. 11, the pixel lines pre-printed on the recording substrate overlap the pixel lines formed by the nozzles of the array.

The adjustment with a nominal distance equal to zero is interesting for graphical applications. The cross section of a possible resulting pattern is partly shown in FIG. 12A. On a recording substrate 30, marks 32 are pre-printed by ink droplets of a first colorant. Shortly following the formation of the marks 32, marks 34 formed by ink droplets of a second colorant are printed on top of the marks 32, using the array of nozzles. Of course, for graphical applications, more colorants may be used. For graphical applications, the deviation factor is preferably obtained by an average function which constrains the deviation factor attributed to a distinct attainable relative position to take the value of an averaged difference, computed in absolute value between the nominal distance and the distances between neighboring first and second marks. The selected attainable relative position is the one having the smallest deviation factor among the plurality of deviation factors. Consequently, the overlapping between first and second marks is on average as good as is possible.

The adjustment with a nominal distance equal to zero may also be interesting for special applications such as these related to the manufacturing for printed circuit boards. The cross section of a possible arrangement of the marks is partly shown in FIG. 12B. On an adequate recording substrate 36, first marks 38 are pre-printed. Preferably, the material used for forming the first marks 38 is an electrically conductive ink or a metal. If liquid metal has been jetted during printing the pre-printed pattern forming the first marks 38, the printhead has to be adapted for expelling liquid metal droplets. On top of the first mark 38, a second mark 40 is formed. The material used for forming the marks 40 may be an electrically insulating ink. For printed circuit board applications, the deviation factor is preferably obtained by a maximum function which constrains the deviation factor attributed to a distinct attainable relative position to take the value of the largest difference, in absolute value, among an ensemble of differences computed between the nominal distance and the distances between neighboring first and second marks. The selected attainable relative position is the one having the smallest deviation factor among the plurality of deviation factors. Consequently, largest errors in the overlap between first and second marks are, as much as possible, avoided. This is of great importance for printed circuit boards applications, to ensure good electrical insulation between conductive tracks, where it is required on the board.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for adjusting a recording substrate and at least one array relative to each other, the recording substrate and the at least one array having a relative position with respect to each other, said array being part of a printing device having a carrying structure for mounting said array and having nozzles arranged in a row substantially parallel to a first direction for forming second test marks on the recording substrate, wherein the recording substrate comprises a pre-printed pattern containing first test marks, the method comprising forming a test pattern by applying the second test marks on the recording substrate, each first and second test mark having a location on the recording substrate;

detecting the locations of the first and second test marks;

determining a plurality of deviation factors for a plurality of attainable relative positions based on said detected locations, wherein said plurality of attainable relative positions are positions wherein the array and the pre-printed pattern at least partially flank each other, thereby defining a degree of overlap, which positions differ in the number of nozzles falling outside the area of overlap, and each one of said deviation factors is an attribute of a distinct attainable relative position and is indicative of an amount by which distances between neighboring first and second marks deviate from a nominal distance;

selecting an attainable relative position among the plurality of attainable relative positions which satisfies a selection criterion applied to the plurality of deviation factors;

bringing the array and the recording substrate into the selected attainable relative position; and using the array for printing a pattern while the array and the recording substrate are in the selected attainable relative position.

2. The method for adjusting a recording substrate relative to at least one array according to claim 1, wherein the selected attainable relative position is the one having the smallest deviation factor among the plurality of deviation factors.

3. The method for adjusting a recording substrate relative to at least one array according to claim 2, wherein a maximum function constrains the deviation factor attributed to a distinct attainable relative position to take the value of the largest difference, in absolute value, among an ensemble of differences computed between the nominal distance and the distances between neighboring first and second test marks.

4. The method for adjusting a recording substrate relative to at least one array according to claim 2, wherein an average function constrains the deviation factor attributed to a distinct attainable relative position to take the value of an averaged difference, computed in absolute value between the nominal distance and the distances between neighboring first and second test marks.

5. The method for adjusting a recording substrate relative to at least one array according to claim 2, wherein a maximum function constrains the deviation factor attributed to a distinct attainable relative position to take the value of the largest difference between the nominal distance and the distances between neighboring first and second test marks.

6. The method for adjusting a recording substrate relative to at least one array according to claim 2, wherein a maximum function constrains the deviation factor attributed to a distinct attainable relative position to take the value of the largest difference between the distances between neighboring first and second test marks and the nominal distance.

7. The method for adjusting a recording substrate relative to at least one array according to claim 1, wherein the nozzles of the at least one array are regularly spaced according to a pitch.

8. The method for adjusting a recording substrate relative to at least one array according to claim 7, wherein the nominal distance is equal to half the pitch.

9. The method for adjusting a recording substrate relative to at least one array according to claim 7, wherein the nominal distance is equal to zero.

10. The method for adjusting a recording substrate relative to at least one array according to claim 1, further comprising the step of displacing at least one of the group of the at least one array and the recording substrate for bringing the printhead into the selected relative attainable position.

11. The method according to claim 10, wherein said step of displacing comprises one of the group consisting of a translation of the at least one array, a rotation of the at least one array and a combination of a rotation and a translation of the at least one array.

12. The method according to claim 10, wherein the nozzles of the at least one array are regularly spaced according to a pitch and said step of displacing further comprises a rotation of the at least one array over such an angle that the pitch multiplied by a cosine of the angle substantially equals a calculated distance of neighboring first test marks in the first direction.

13. A printing device comprising:

at least one array mounted on a carrying structure, the at least one array having nozzles arranged in a row substantially parallel to a first direction for forming second test marks on a recording substrate, the substrate comprising a pre-printed pattern containing first test marks, wherein the at least one array and the recording substrate are in an attainable relative position;

a displacement device configured to displace at least one of the group of the at least one array and the recording substrate; and a control unit configured to control the at least one array for applying the second test marks on the recording substrate, foaming a test pattern, each first and second test mark having a location on the substrate, and to control a detector configured to detect the locations of the first and second test marks, wherein the control unit is configured to control a computing module for executing the steps of determining a plurality of deviation factors for a plurality of attainable relative positions based on said detected locations, wherein said plurality of attainable relative positions are positions wherein the array and the pre-printed pattern at least partially flank each other, thereby defining a degree of overlap, which positions differ in the number of nozzles falling outside the area of overlap, and each one of said deviation factors is an attribute of a distinct attainable relative position and is indicative of an amount by which distances between neighboring first and second test marks deviate from a nominal distance, selecting an attainable relative position among the plurality of attainable relative positions which satisfies a selection criterion applied to the plurality of deviation factors, bringing the array and the recording substrate into the selected attainable relative position, and using the array for printing a pattern while the array and the recording substrate are in the selected attainable relative position.

14. The printing device according to claim 13, wherein the control unit is configured to control the displacement device for causing the at least one array and the substrate to have the selected attainable relative position.

15. The printing device according to claim 13, wherein the detector is a camera mounted on a carriage and arranged for scanning the test pattern.

16. The printing device according to claim 15, wherein the camera is a CCD camera which is arranged for determining a geometrical center of gravity of each one of the first and second test marks in the test pattern and extracting coordinates of said first and second test marks along an axis.

17. The printing device according to claim 13, wherein the nozzles of the at least one array are regularly spaced according to a pitch.

18. The printing device according to claim 17, wherein the nominal distance is equal to half the pitch.

19. The printing device according to claim 17, wherein the nominal distance is equal to zero.

20. The printing device according to claim 13, wherein the at least one array is mounted on a carriage, and the carriage and the recording substrate are moveable relative to each other in a second direction normal to the first direction.

21. The printing device according to claim 13, wherein the displacement device comprises a piezoelectrical actuator.

22. An ink jet printer comprising a printing device according to claim 13.

23. A computer program product residing on a non-transitory computer readable medium comprising instructions for causing at least one process unit to perform a method for adjusting a recording substrate and at least one array relative to each other, the recording substrate and the at least one array having a relative position with respect to each other, said array being part of a printing device having a carrying structure for mounting said array and having nozzles arranged in a row substantially parallel to a first direction for forming second test marks on the recording substrate, wherein the recording substrate comprises a pre-printed pattern containing first test marks, the method comprising forming a test pattern by applying the second test marks on the recording substrate, each first and second test mark having a location on the recording substrate;

detecting the locations of the first and second test marks;

determining a plurality of deviation factors for a plurality of attainable relative positions based on said detected locations, wherein said plurality of attainable relative positions are positions wherein the array and the pre-printed pattern at least partially flank each other, thereby defining a degree of overlap, which positions differ in the number of nozzles falling outside the area of overlap, and each one of said deviation factors is an attribute of a distinct attainable relative position and is indicative of an amount by which distances between neighboring first and second marks deviate from a nominal distance;

selecting an attainable relative position among the plurality of attainable relative positions which satisfies a selection criterion applied to the plurality of deviation factors, bringing the array and the recording substrate into the selected attainable relative position; and using the array for printing a pattern while the array and the recording substrate are in the selected attainable relative position.

* * * * *

UNITED STATES PATENT AND TRADEMARK OFFICE

CERTIFICATE OF CORRECTION

PATENT NO. : 8,469,480 B2
APPLICATION NO. : 12/953006
DATED : June 25, 2013
INVENTOR(S) : Hylke Veenstra It is certified that error appears in the above-identified patent and that said Letters Patent is hereby corrected as shown below:

ON THE TITLE PAGE:

Item (73), Assignees should read as follows:

--(73) Assignees: Océ Technologies B.V., Venlo (NL); Mutracx, Helmond (NL)--.

Item (63), Related U.S. Application Data should read as follows:

--(63) Continuation of application No. PCT/EP2009/056282, filed on May 25, 2009.--.

Signed and Sealed this
Third Day of December, 2013

Margaret A. Focarino

Margaret A. Focarino
*Commissioner for Patents of the United States Patent and Trademark Office*